US007299927B2

(12) United States Patent
Emter et al.

(10) Patent No.: US 7,299,927 B2
(45) Date of Patent: Nov. 27, 2007

(54) STACKABLE WAFER CONTAINER WITH RAISED HANDLE AND RIBS

(75) Inventors: Steven R. Emter, Murrieta, CA (US); David M. Christensen, Fallbrook, CA (US)

(73) Assignee: Peak Plastic & Metal Products (International) Limited, Hong Kong (HK)

( * ) Notice: Subject to any disclaimer, the term of this patent is extended or adjusted under 35 U.S.C. 154(b) by 166 days.

(21) Appl. No.: 11/052,727

(22) Filed: Feb. 7, 2005

(65) Prior Publication Data

US 2006/0175220 A1 Aug. 10, 2006

(51) Int. Cl.
*B65D 85/00* (2006.01)
*B65D 85/30* (2006.01)
*B65D 21/036* (2006.01)

(52) U.S. Cl. ..... 206/710; 206/454; 206/510; 211/41.18; 220/23.6

(58) Field of Classification Search ..... 206/710–711, 206/454, 303, 445, 508, 510, 509, 511; 220/4.26–4.27, 220/297, 784, 23.6
See application file for complete search history.

(56) References Cited

U.S. PATENT DOCUMENTS 1,444,135 A 2/1923 O'Connor
1,965,175 A * 7/1934 Dolan ..... 206/510
2,678,861 A * 5/1954 Funk ..... 220/4.27
3,270,922 A * 9/1966 Schmidt ..... 206/509
3,369,691 A * 2/1968 Wei ..... 220/4.27
3,759,416 A 9/1973 Constantine
3,913,741 A * 10/1975 Pirie ..... 206/508
4,705,163 A 11/1987 James
5,542,206 A * 8/1996 Lisch ..... 220/4.27
5,611,448 A * 3/1997 Chen ..... 220/4.27
5,671,856 A * 9/1997 Lisch ..... 220/4.27
6,193,068 B1 2/2001 Lewis
6,237,771 B1 5/2001 Haq
6,533,123 B1 3/2003 Nakamura
6,662,950 B1 12/2003 Cleaver
2004/0005209 A1 1/2004 Su
2004/0099548 A1* 5/2004 Ito et al. ..... 206/303

* cited by examiner

*Primary Examiner*—Bryon P Gehman
(74) *Attorney, Agent, or Firm*—Isabelle R. McAndrews

(57) ABSTRACT

A wafer container comprising a base and a cover that nest together. The cover includes tabs on a lower portion that engage notches on the frame. The cover can be combined with the base without indexing to a precise opening on the frame. A handle on the cover enables an operator to easily rotate the container into a locked position. A ribbed pattern on the exterior surface of the frame enables the wafer container to be stacked with another wafer container.

13 Claims, 5 Drawing Sheets

STACKABLE WAFER CONTAINER WITH RAISED HANDLE AND RIBS

FIELD OF THE INVENTION

The invention relates to a wafer container for handling wafers between processing stations or for transporting wafers outside a production facility.

BACKGROUND OF THE INVENTION

Conventional wafer containers have two sections: a cover and a base. One such container is described in U.S. Pat. No. 6,237,771 (Haq). Haq discloses a cover and a base with receiving apertures. It is essential that the projections align with the receiving apertures to allow the container to be properly locked.

Once the projections align with the apertures, the two sections of the wafer container can be locked into place. If the top section is not properly aligned, the cover will have to be lifted and reinserted into the correct position. It is also difficult to observe in the Haq container whether the cover is engaging correctly to the base.

When a container is not properly locked it affects the stability of a stack of wafer containers. An improperly closed container may cause a stack of wafer containers to unnecessarily shift in position. It is also time consuming for an operator to remove covers from within a stack of containers to determine which container is responsible for the instability. Moreover, most wafer containers lack a gripping area that allows an operator to easily grip the cover for removal.

A need exists for a wafer container that has increased stability during stacking, a gripping area, and that is not constrained to specific angles when the top section (cover) engages to the base. A need also exists for a wafer container that allows an operator to easily observe if the two sections have correctly engaged to each other.

SUMMARY OF THE INVENTION

The present invention concerns a wafer container comprising a base having a cylindrical wall structure and a frame. On the frame are notches that extend to an edge of the frame. Tabs extend from a cylindrical cover to engage with the notches on the frame thereby forming a closed wafer container.

Another embodiment of the invention concerns a stackable wafer container comprising a base and a cover that lock into a closed position. The base includes a pattern on an exterior region that is contoured to mate with an upper surface of the cover of a second wafer container.

Yet another embodiment of the invention is directed to a wafer container that is provided with a gripping area on the cover that facilitates the disassembly of the two sections of the container.

DETAILED DESCRIPTION OF THE INVENTION

Figure 1:
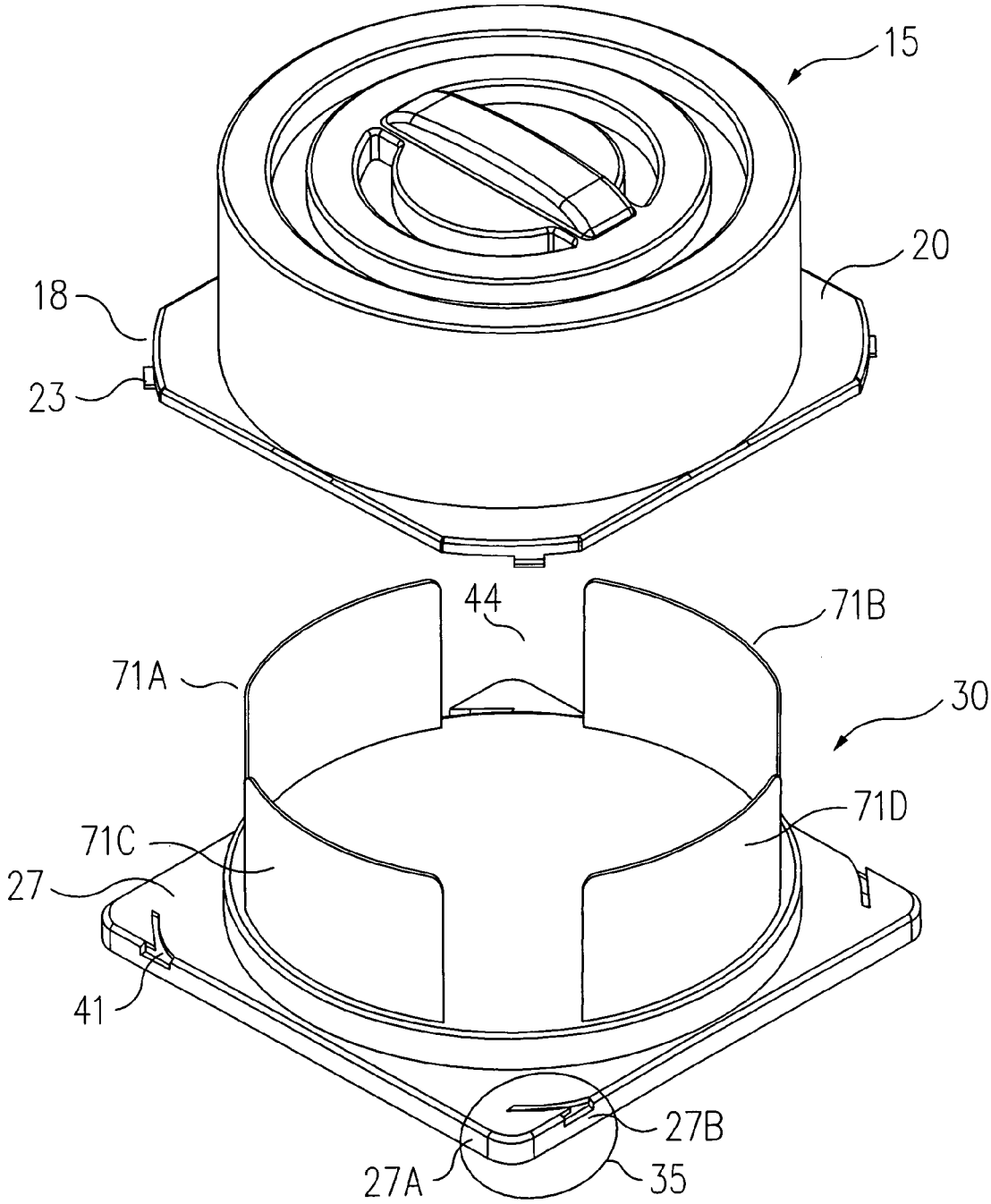
FIG. 1 is a perspective view of the disassembled wafer container.

To solve the above problems, the wafer container of the present invention was developed. FIG. 1 is a perspective view of the two sections of the wafer container of the present invention. FIG. 1 illustrates a cylindrical cover 15 that has a deck 20 near its open end. The deck 20 has chamfered corners 18 on which tabs 23 are attached. Cover 15 has a diameter that is greater than the diameter of the circumference defined by wall structure 71 of base 30. This allows cover 15 to nest onto walls 71A-71D of the base. Walls 71A-71D extend from a substantially square-shaped frame 27. Within frame 27 are open edges 41 cut out on more than one corner region 35. Corner regions 35 include a corner and a portion of the frame walls, 27A and 27B, adjacent each corner as shown in FIG. 1. Each open edge, or notch 41, engages with a corresponding tab 23 to form a closed container.

Figure 2:
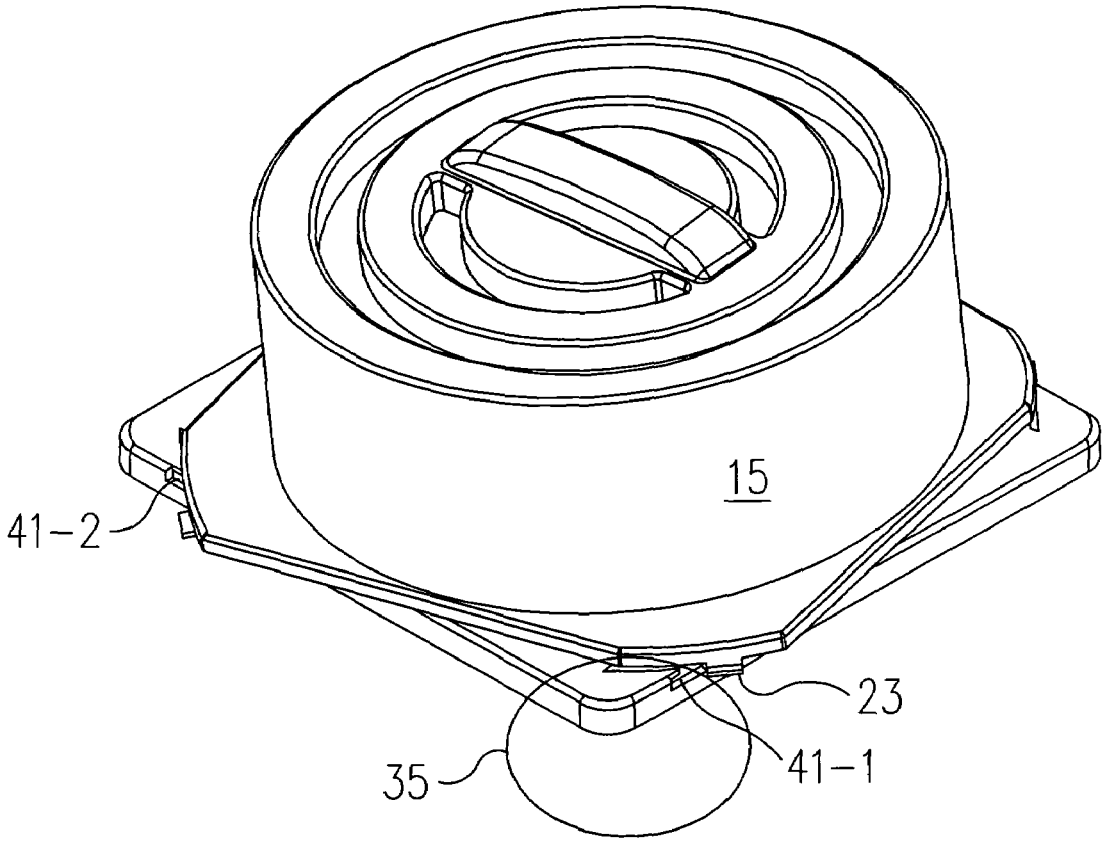
FIG. 2 is a perspective view of the cover as it is being rotated into the base of the container.

To secure wafers within wafer container 100, cover 15 is lowered onto base 30. Cover 15 is rotated clockwise as shown in FIG. 2 until tabs 23 engage with notches 41 at corner regions 35 of base 30. Tabs 23 can engage the base from any angle and need not be indexed to a specific spot as in the prior art. In FIG. 2 notches 41-1 and 41-2 are shown at specific locations on corner regions 50. However, notches 41 can instead be placed at a different location of the corner region 35.

Figure 3:
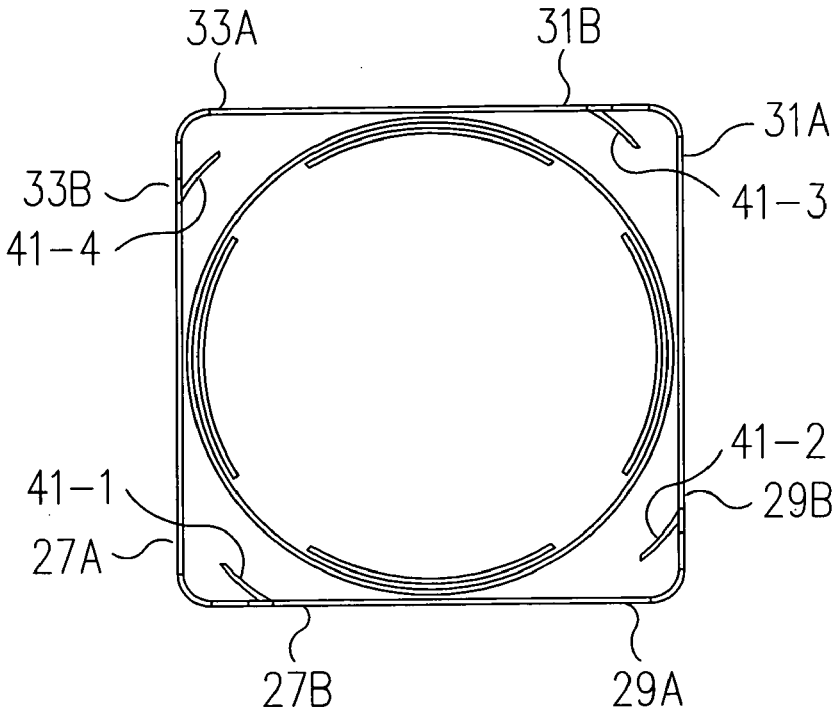
FIG. 3 illustrates a top view of the base of the present invention.

FIG. 3 illustrates a top view of the base, wherein notches are located on frame walls 27B, 29B, 31B and 33B. Notch 41-1 can instead appear on frame wall 27A, that is at a 90° angle to frame wall 27B. Similarly, notches 41-2, 41-3, and 41-4 can be placed on walls 29A, 31A and 33A respectively instead on the frame walls shown in FIG. 3. Of course, if notches 41-1, 41-2, 41-3, and 41-4 appear on frame walls, 27A, 29A, 31A and 33A respectively, the cover of wafer box 100 will be rotated counterclockwise to engage the tabs with notches 41.

Figure 4:
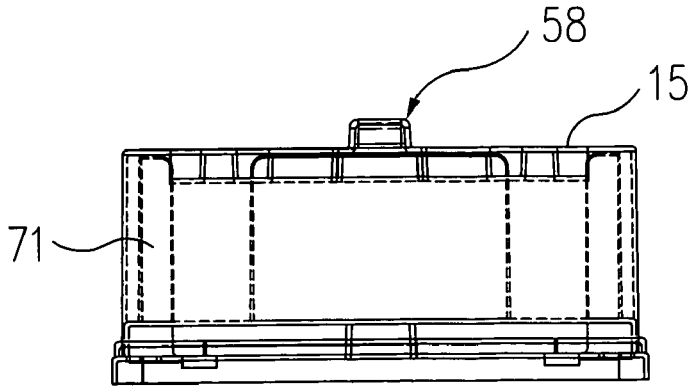
FIG. 4 illustrates a side view of the assembled wafer container.

FIG. 4 illustrates the assembled wafer container 100. On cover 15 a raised handle 58 is shown. Handle 58 enables an operator to grip the cover to lock the two sections 15 and 30 into place. In addition, handle 58 may be rotated in a counterclockwise direction to disengage the tabs from notches 41, thereby unlocking the cover when the notches 41 are in the position illustrated in FIG. 3. In an unlocked position, cover 15 is simply lifted from base 30 to insert, inspect or remove the contents therein.

Wall structure 71 preferably has at least one lateral opening 44 perpendicular to the horizontal plane of base 30. Lateral openings 44 facilitate an operator's access to the wafers and any other contents stored within wafer container 100. Additional contents may include separator sheets to prevent dust from accumulating and to prevent scratches to wafer surfaces. The separators may be for example thin disks constructed of paper or foam, and/or a carbon impregnated material. In addition, a plastic insert, foam, or sponge material may be used to fill any empty space of a container that is not filled to capacity. However, the present invention excludes the use of any foamed padding that is attached to cover 15 or walls 27A-27D.

Cover 15 is configured to nest with the wall structure 71 of base 30. When cover 15 and base 30 are nested together, there is a limited clearance between wall structure 71 and cover 15. The wall structure thereby constrains the contents of the wafer box 100 to limit movement of the wafers 10 during shipment and handling.

Figure 5:
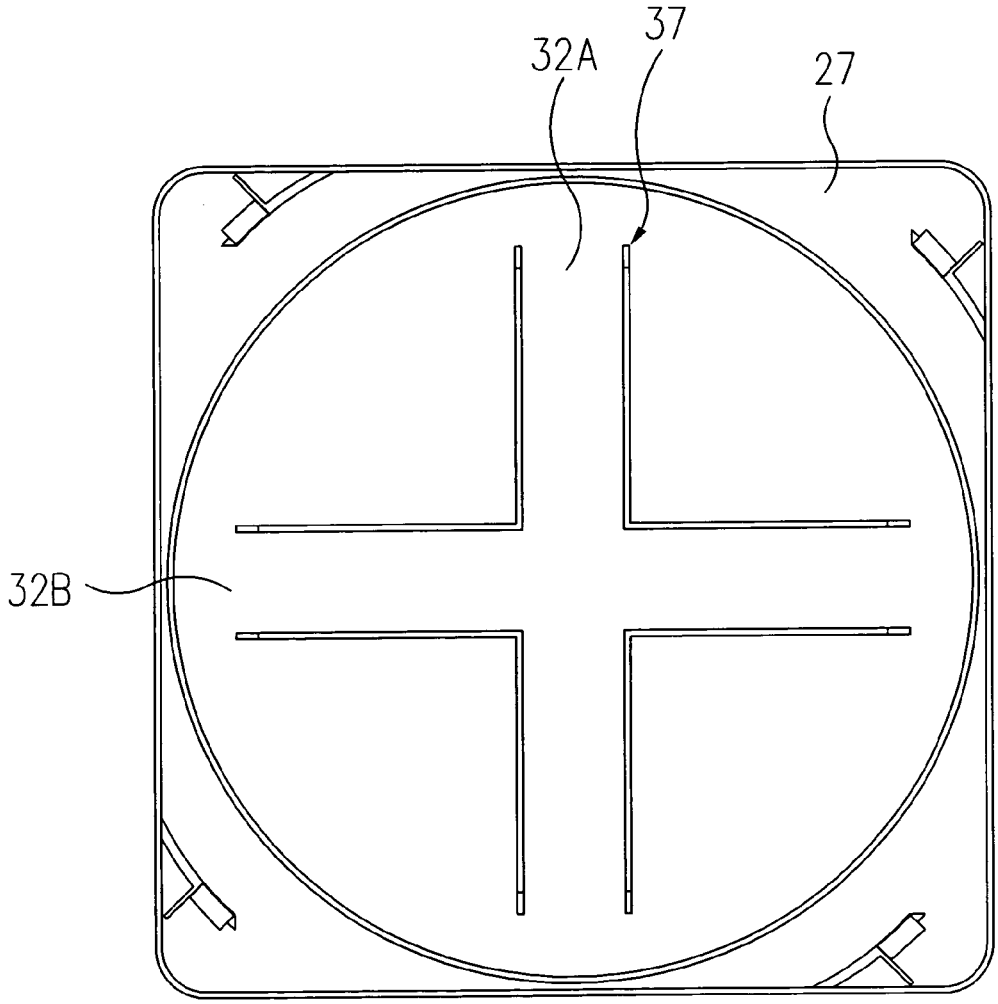
FIG. 5 illustrates a planar bottom view of the base of FIG. 3.

The containers of the present invention are also stackable. FIG. 5 illustrates the exterior bottom surface of base 30. Base 30 has multiple locations at which it can align to the top of a second container. These locations comprise parallel longitudinal areas 32 that traverse the planar exterior surface of frame 27. Although a single pair of longitudinal ribs in the form of an "=" sign would suffice for stacking purposes, it is preferred to provide multiple parallel longitudinal areas 32 on frame 27. In either case, ribs 37 are symmetrical along each axis that extends through the space that lies between ribs 37.

Figure 6:
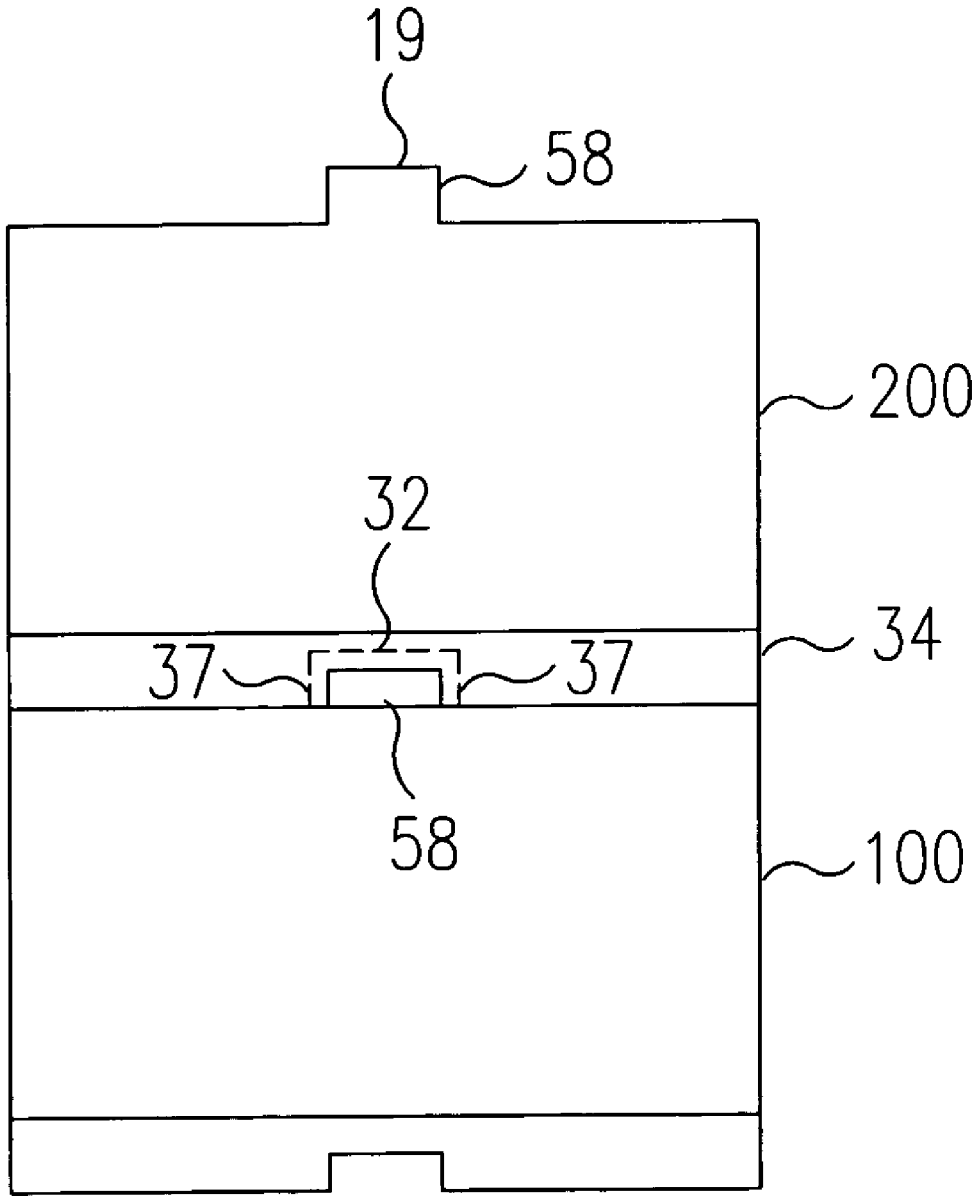
FIG. 6 illustrates a simplified sectional view of a stack of wafer containers.

In a preferred embodiment, longitudinal area 32 is a cross-shaped pattern 32 that receives handle 58 when the container is in a locked orientation. Ribs 37 of a second container 200 mate with handle 58 of container 100 as shown in FIG. 6. When the cover of container 100 is misaligned with the base of container 200, base 34 is rotated no more than 90° until the two containers are aligned to each other in stacking formation. Accordingly, handle 58 will reside in either the longitudinal space 32A between ribs 37 or the longitudinal space 32B between ribs 37. In this manner, the base from a second container 200 can be stacked on the cover of a first container 100.

In a preferred embodiment, the height of ribs 37 is greater than the height of handle 58. More specifically, pattern 32 is defined by ribs 37 that are between approximately 0.60 and 0.70 inches in height and between approximately 0.075 and 0.085 inches in width. In a more preferred embodiment, ribs 37 have a height of approximately 0.65 inches and a thickness of approximately 0.080 inches. These dimensions ensure that the ribs do not contact the upper planar surface 19 of handle 58 during stacking. In addition, the planar space between ribs 32A and 32B does not contact handle 58 either when covered containers 100 and 200 are stacked together. Containers stacked in accordance with the present invention are maintained in a stable position for shipping and do not rotate out of position.

The containers of the present invention are preferably manufactured with a standard injection molding process. Suitable manufacturing materials for the present invention include conductive, thermoplastic, non-conductive, and insulated plastic. In addition, the wafer containers can be fabricated from material that has electrostatic dissipating properties.

The specific examples provided above are intended to be illustrative of the invention only. It should be apparent to those skilled in the art that various features of the invention may be modified without departing from the spirit and scope of the invention. It is therefore the intent that the scope of the invention is to be defined by the appended claims.

What is claimed:

1. A wafer container comprising:

a) a base including a frame having a first longitudinal space defined between a portion of a plurality of ribs and a second longitudinal space defined between a different portion of the plurality of ribs, each of said longitudinal spaces being located on an exterior bottom surface of the frame, wherein said first longitudinal space is transverse to said second longitudinal space;

b) a cylindrical wall structure attached to the base;

c) a cylindrical cover having a raised handle, so that when said wafer container has an adjacent identical wafer container, stacked on top thereof said handle fits within only one of said longitudinal spaces of the adjacent identical wafer container at any one time, when the two wafer containers are stacked on each other.

2. The wafer container of claim 1, wherein the ribs adjacent said first longitudinal space are symmetrical to each other along a first axis that extends through the first longitudinal space and the ribs adjacent said second longitudinal space are symmetrical along a second axis orthogonal to said first axis, said second axis being located through said second longitudinal space.

3. The wafer container of claim 1, further comprising a plurality of tabs attached to an exterior surface of the cylindrical cover.

4. The wafer container of claim 3, wherein the cylindrical cover includes chamfered corners, and the tabs are located on each of said corners.

5. The wafer container of claim 1, wherein the wall structure has a plurality of lateral openings perpendicular to the base.

6. The wafer container of claim 1, wherein more than one notch is provided in a location on the base that is separate from said wall structure.

7. The wafer container of claim 6, wherein said notches extend to an outer edge of the frame and engage tile tabs of the cylindrical cover.

8. A wafer container assembly of stacked wafer containers substantially identical to each other comprising:

a) a first wafer container that includes a base on a frame, a wall structure attached to said frame; the frame including a more than one notch separate from the wall structure of the base;

b) a cylindrical cover having an exterior surface a plurality of tabs attached to said exterior surface and a raised handle, wherein the cylindrical cover is secured to the base when one of the plurality of tabs engages to its corresponding notch; and c) the base having an exterior bottom surface receiving the raised handle on the cover of a second wafer container during stacking, said exterior bottom surface having a first longitudinal space defined between a portion of a plurality of ribs and a second longitudinal space defined between a different portion of the plurality of ribs, wherein the first longitudinal space is transverse to the second longitudinal space, and wherein any misalignment between the two containers is corrected by rotating the containers no more than 90 degrees with respect to one another.

9. The wafer container assembly of claim 8, wherein said raised handle of the second wafer container fits within only the first longitudinal space or the second longitudinal space of the first wafer container at any one time.

10. The wafer container assembly of claim 8, wherein the cylindrical cover has a deck with chamfered corners.

11. The wafer container assembly of claim 10, wherein one of said plurality of tabs is attached to each chamfered corner of the cylindrical cover.

12. The stackable wafer assembly of claim 8, wherein said frame has four corner regions and one of said notches is located on each of said corner regions.

13. The wafer container assembly of claim 8, wherein the wall structure of the base has at least one lateral opening.

* * * * *